United States Patent [19]

Siemers et al.

[11] 4,327,120

[45] Apr. 27, 1982

[54] METHOD FOR COATING A METAL SUBSTRATE

[75] Inventors: Paul A. Siemers, Clifton Park; Harvey D. Solomon, Schenectady, both of N.Y.

[73] Assignee: General Electric Company, Schenectady, N.Y.

[21] Appl. No.: 229,243

[22] Filed: Jan. 28, 1981

[51] Int. Cl.[3] ..... B05D 1/08; B05D 5/06

[52] U.S. Cl. ..... 427/34; 356/5; 356/318; 250/302; 250/461 R; 427/10; 427/157; 427/160; 427/236; 427/423; 428/35

[58] Field of Search ..... 427/8, 10, 142, 157, 427/160, 34, 404, 405, 419.2, 236, 423; 73/7; 428/621, 35, 623, 632, 686, 469, 539, 639; 356/5, 318; 250/302, 461 R

[56] References Cited

U.S. PATENT DOCUMENTS 3,927,223 12/1975 Takabatake et al. ..... 427/34
4,101,715 7/1978 Rairden ..... 428/652

OTHER PUBLICATIONS

Arc Plasma Technology in Materials Science, Gerdeman et al, Springer-Verlag, Wien, New York, (1972), pp. 70, 71 & 145.

*Primary Examiner*—Shrive P. Beck
*Attorney, Agent, or Firm*—William A. Teoli; James C. Davis, Jr.

[57] ABSTRACT

A plasma or flame spraying method is provided for applying a ceramic or metallic UV sensitive indicating coating onto a metal substrate. Particle size control of the ingredients used in the plasma or flame sprayable mixture has been found to enhance the fluorescence of the resulting indicating coating.

9 Claims, No Drawings

METHOD FOR COATING A METAL SUBSTRATE

CROSS REFERENCE TO RELATED APPLICATIONS

Reference is made to the copending application of Rodney Hanneman, Ser. No. 220,663, filed Dec. 29, 1980, for Coated Metal Structures and Method for Making Same and assigned to the same assignee as the present invention.

BACKGROUND OF THE INVENTION

As described in copending application Ser. No 220,663, metal structures having UV sensitive indicating coatings can be made by plasma spraying a mixture of a UV sensitive metal oxide phosphor, for example, cerium magnesium aluminate doped with +3 terbium and a metal powder, for example, Metco 450Ni powder. The resulting coated metal structure can be used in a variety of applications subject to a high degree of surface erosion. As taught in copending application Ser. No. 220,663, the phosphor containing coating can serve as a UV sensitive indicating layer.

Experience has shown that in practicing the method of Ser. No. 220,663, commercially available UV sensitive phosphors often result in indicating coatings having substantially reduced fluorescence, as compared to the degree of fluorescence in the original unsprayed mixture of ingredients. Various explanations have been proposed as to the possible reason for the significant drop in fluorescence of the applied coating as compared to the original mixture prior to plasma spraying. One possible explanation is that the phosphor particles and metal particles in the initial plasma or flame sprayed mixture do not melt before they strike the metal substrate. This explanation is supported by D. A. Gerdeman et al, Arc Plasma Technology in Materials Science, Springer-Verlag, Wien, NY, 1972. This lack of proper melting can cause particles to bounce off the surface of the substrate, or to be blown out of the plasma stream and therefore not strike the substrate.

The present invention is based on the discovery that by plasma or flame spraying a mixture of a UV sensitive metal oxide phosphor and a plasma or flame sprayable metal, metal carbide, or metal oxide, where such ingredients are in a critical particle size range, as described hereinafter, the resulting ceramic or metal indicating coating has a substantially enhanced degree of fluorescence under UV light, as compared to plasma or flame sprayed coatings utilizing a mixture of such ingredients in a particle size range outside the critical range.

STATEMENT OF THE INVENTION

A method which comprises, plasma or flame spraying a metal substrate with a UV sensitive indicating mixture comprising, (1) a particulated plasma or flame sprayable hardcoat material selected from metal, metal carbide or metal oxide, (2) an effective amount of a particulated UV sensitive metal oxide phosphor, where hardcoat component H and phosphor component P of such UV sensitive indicating mixture are further characterized with respect to particle diameter $D_H$ and $D_P$, respectively, in accordance with the following Energy of Melting ($E_M$) formula, $$\frac{D_H}{D_p} = \frac{(E_M)_p \sqrt{\rho_p}}{(E_M)_H \sqrt{\rho_H}}$$

where $D_H$=diameter of hardcoat particles, $D_P$=diameter of phosphor particle, $\rho_H$=density of hardcoat particle, $\rho_P$=density of phosphor particle and $E_M = C_P \cdot \Delta T_M + H_f$, where $C_P$=specific heat, $\Delta T_M$=increment in temperature required to melt the particle and $H_f$=Heat of fusion.

Particulated metal oxides and UV sensitive metal oxide phosphors which can be plasma or flame sprayed onto the surface of metallic substrates in accordance with the practice of the present invention can have an average particle size of from 5 to 150 microns and preferably from 25 to 100 microns. There are included among the powdered metal oxides, compounds such as $Al_2O_3$, $BaTiO_3$, $CeO_2$, $Cr_2O_3$, MgO, $TiO_2$, $ZrO_2$, and $ZrSiO_2$.

Metal carbides can also be utilized in the practice of the present invention. These metal carbide powders can have a particle size of from 2 to 150 microns and preferably from 5 to 110 microns and include, for example, CrC, HfC, ZrC, and WC.

Various procedures can be used to adjust the size of the metal oxide phosphor particles utilized in the practice of the present invention, in instances where the phosphor particle size is outside the critical range. One method is by spray drying as shown in Kristiniak, U.S. Pat. No. 3,373,119 and U.S. Pat. No. 3,429,962, which are assigned to the same assignee as the present invention. The spray drying process involves suspending the metal oxide phosphor in a solvent to form a slip and then spray drying the resulting mixture into a hot drum. The fluid of the slip evaporates leaving powder particles having a borad particle size range. The spray dried particles can then be screened to eliminate the particles which do not fall within the critical range previously defined. If desired such spray drying procedures also can be used to adjust the particle size of other metal oxides free of a UV sensitive phosphor.

Flame sprayable or plasma sprayable metal powders also can be utilized in the practice of the present invention. These metal powders can have a particle size of from 10 to 25 microns and include, for example, Co, Cr, Mo, Ni and W. Alloy powders can also be used. The 450 Ni powder used in the Examples is an example of just one such an alloy. These alloys include Ni-Cr alloys, Fe-Cr-Ni stainless alloys and Co base alloys. The alloy powders are generally in the same size range as the metal powders.

The phosphors which can be employed in combination with any of the above described metal oxides, metal carbides, or metal powders include such materials as yttrium oxide doped with +3 europium, $Ce_{1-X-Y}La_XTb_YMgAl_{11}O_{19}$, where $O<X<0.2$ and $0.2<Y<.4$, and specifically $Ce_{.7}Tb_{.3}MgAl_{11}O_{19}$, (CAT). Additional phosphors which also can be used are, for example, $Zn_2SiO_4$, doped with Mn or As, $La_2O_2S$ doped with Tb, $YVO_4$ doped with Eu, $Y_2O_3$ doped with Eu, $Y_2O_2S$ doped with Eu, $CaWO_4$, ZnS doped with Ag or Cu, ZnCdS doped with Cu or Ag, $KMgF_3$ doped with Mn, $Gd_2O_2S$ doped with Tb.

Among the metal substrates which can be treated in accordance with the method of the present invention are, for example, valve seats, turbine buckets, turbine blades, vanes, combustor liners, transition pieces, nozzles, reaction vessels, pressure vessels, boilers.

There can be used from 1 to 75% by volume of metal oxide phosphor, based on the total volume of the mixture of metal oxide phosphor and hardcoat material which is applied to the substrate.

Effective results can be determined by measuring the difference between the light emitted from a surface substantially free of phosphor with a surface having an effective amount of phosphor, as previously defined. A standard 256 NM UV lamp, held at a distance sufficient to provide a light intensity of 1200μwatts per sq. cm will show an increase of at least 0.1 Ft. Lamberts over the background when used on a surface derived from a sprayable mixture containing an effective amount of UV sensitive phosphors compared to a coating derived from a mixture free of phosphor, intensities of over 80 Ft. Lamberts have been recorded.

In the practice of the present invention, a metal substrate can be initially plasma or flame sprayed to a thickness of 100 microns or more of UV sensitive indicating mixture, which hereinafter will signify a mixture of the above described metal oxide phosphor with a hardcoat material, such as metal powder, metal oxide powder, or metal carbide powder as previously defined. Plasma temperatures and the corresponding particle residence time must be sufficient such that melting of each species occurs. A detailed description of the conditions used in conventional plasma or flame spraying can be found in U.S. Pat. Nos. 4,055,705, Palmer et al and 4,095,003, Weatherly et al.

EXAMPLE 1

A slurry was prepared of 50 percent by weight of a UV sensitive phosphor having the approximate formula, $$Ce_{.7}Tb_{.3}MgAl_{11}O_{19},$$

and 50% by weight of liquid consisting of 35 to 100% by weight of water and 0 to 65% by weight of denatured alcohol. The mixture also contained from 1.5% by weight to 2.25% by weight of Methocel, methylcellulose, a binder produced by Dow Chemical Company, Midland, Michigan. In addition, the mixture also contained 1% by weight to 30% by weight of triethanolamine as well as 1% by weight to 3% by weight of ammonia. This liquid portion of the slurry is taught by Kristiniak, U.S. Pat. No. 3,373,119 as previously cited. The resulting slip was then spray dried into a hot drum. The fluid of the slip evaporated leaving powder particles of UV phosphor. The resulting particles were then screened into three lots consisting of particles having a diameter of less than 44 microns (−325 mesh), particles between 44 microns and 74 microns (−200+325 mesh), and particles greater than 74 microns (+200 mesh). Various blends were made by mixing equal parts by volume of one of the three above mentioned sized lots of UV phosphor and Metco 450 Ni powder (a nickel aluminum powder obtained from Metco Inc., Westbury, NY). The powders were mixed by rolling in a jar for several days. Blend (A) consisted of the 450 Ni powder and the coarse fraction (>74 microns) of the UV phosphor, blend (B) consisted of a mixture of 450 Ni powder and the UV phosphor medium fraction (between 44 and 74 microns) and Blend (C) consisted of a mixture of the 450 Ni powder and the fine fraction (<44 microns) of the UV phosphor.

These blends were plasma sprayed onto 2 inch by 2 inch carbon steel substrates. Approximately 0.005 to 0.010 inches was deposited by a Metco 3M plasma spray system manufactured by Metco Co. The spray distance was approximately 6 to 8 inches and a current of 500 Amps was used with an Argon 20% Hydrogen plasma gas and an Argon gas carrier stream to carry the powder from the powder feeder.

The degree of fluorescence from each treated slab was measured by shining a 254 NM light on to the substrate using an intensity of approximately 1200μ Watt/cm$^2$. The fluorescence was measured approximately 7.5 inches from the substrate with a Model UB Spectron Brightness Spot Meter, manufactured by the Photo Research Corp., Burbank, Calif. The intensities of fluorescence of the three blends is as follows:

TABLE I

| Blend | Fluorescence (Ft-Lamberts) |
|---|---|
| A | 4.4 |
| B | 15.7 |
| C | 5.5 |

The above results show that the coating derived from Blend B having phosphor particles with an average diameter "D" in the range of 44μ to 74μ provided the highest degree of fluorescence. This result could have been predicated from the aforementioned formula, $$\frac{D_H}{D_p} = \frac{\sqrt{247.8}\ (1285.2)}{\sqrt{368.3}\ (525.6)} = 2$$

if the UV phosphor (P) is assumed to have the same density, (247.8 lb/ft$^3$) and energy of melting (1285.2 BTU/lb) as $Al_2O_3$, while the hardcoat (H), which is essentially NiAl, has a density of (368.3 lb/ft$^3$) and an energy of melting of (525.6 BTU/lb). For optimum deposition, the aforementioned formula requires that the hardcoat powder particles should have twice the diameter as the phosphor. The diameter of the hardcoat powder was approximately 100μ which is about twice the size of the blend B phosphor particle size, hence the improved fluorescence.

EXAMPLE 2

The procedure of Example 1 was repeated, except that the plasma sprayed blends consisted of 2 parts by volume of the 450 Ni powder to one part by volume of the UV Phosphor. In blend D, the UV phosphor (the as received powder) had an average particle size of 1–2 microns, while Blend (E) employed the phosphor having an average particle size of 44–74 microns. Table II shows the results obtained.

TABLE II

| Blend | Fluorescence (Ft-Lamberts) |
|---|---|
| D | 0.3 |
| E | 3.5 |

The above results further dramatically illustrates the criticality of diameter sizes of the components used in plasma sprayed mixtures with respect to the ability of the particles to be retained in the applied coating. Increasing the particle size of the phosphor to the optimum size, increased the fluorescence by more than an order of magnitude, compared to that obtained with the typical as received phosphor particles.

Although the above examples are directed to only a few of the very many variables of the present invention, it should be understood that the method of the present invention includes plasma spraying or flame spraying of a much broader variety of blends of UV metal oxide phosphors and hardcoat materials, for example, metal oxides, metal carbides and metals.

What we claim as new and desire to secure by Letters Patent of the United States is:

1. A method which comprises, plasma or flame spraying a metal substrate with a UV sensitive indicating mixture comprising, (A) a particulated plasma or flame sprayable hardcoat material selected from the group consisting of metal, metal carbide or metal oxide, (B) an effective amount of a particulated UV sensitive metal oxide phosphor, where hardcoat component (H) and phosphor component (P) of such UV sensitive indicating mixture are further characterized with respect to particle diameter $D_H$ and $D_P$, respectively, in accordance with the following Energy of Melting ($E_M$) formula, $$\frac{D_H}{D_p} = \frac{(E_M)_p \sqrt{\rho_p}}{(E_M)_H \sqrt{\rho_H}}$$

where $D_H$=diameter of hardcoat particles, $D_P$=diameter of phosphor particle, $\rho_H$=density of hardcoat particle, $\rho_P$=density of phosphor particle and $E_M = C_P \Delta T_M + H_f$, where $C_P$=specific heat, DETAL $T_M$=increment in temperature required to melt the particle and $H_f$=Heat of fusion.

2. A method in accordance with claim 1, where the UV sensitive metal oxide phosphor is an alumina based phosphor having the formula, $$Ce_{1-X-Y}La_XTb_YMgAl_{11}O_{19},$$

where X is between 0 and 0.2 and Y is between 0.2 and 0.4.

3. A method in accordance with claim 1, where the UV sensitive metal phosphor is $$Ce_{.7}Tb_{.3}MgAl_{11}O_{19}$$

4. A method in accordance with claim 1, where the resulting plasma or flame sprayed substrate is further plasma or flame sprayed with a powdered metal or metal oxide powder to produce an adherent uniform top coating.

5. A method which comprises, (1) plasma or flame spraying a metal substrate with a mixture comprising, (a) an effective amount of a UV sensitive phosphor having the formula, $$Ce_{1-X-Y}La_XTb_YMgAl_{11}O_{19},$$

where X is between 0 and 0.2 and Y is between 0.2 and 0.4, and an average particle size in the range of 5 to 150 microns, and (b) a particulated plasma or flame sprayable metal, or metal oxide, having a particle size in the range of 2 to 150 microns, (2) plasma or flame spraying the resulting coated substrate of (1) with a powdered metal or powdered metal oxide.

6. A method in accordance with claim 5, where the metal substrate is a turbine bucket.

7. A method in accordance with claim 5, where the metal substrate is the inside of a pressure vessel or boiler.

8. A method in accordance with claim 5, where the plasma sprayed metal is 450Ni.

9. A method in accordance with claim 5, where the UV sensitive phosphor is $$Ce_{.7}Tb_{.3}MgAl_{11}O_{19}.$$

* * * * *

UNITED STATES PATENT AND TRADEMARK OFFICE

CERTIFICATE OF CORRECTION

PATENT NO. : 4,327,120

DATED : April 27, 1982

INVENTOR(S) : Paul A. Siemers and Harvey D. Solomon

It is certified that error appears in the above—identified patent and that said Letters Patent is hereby corrected as shown below:

Column 5, line 34, cancel "DETAL" and substitute -Δ-

Column 2, line 38, cancel "borad" and substitute -broad-

Signed and Sealed this

*Sixth* Day of *July 1982*

[SEAL]

*Attest:*

GERALD J. MOSSINGHOFF

*Attesting Officer*

*Commissioner of Patents and Trademarks*